US010400814B2

(12) United States Patent
Snow et al.

(10) Patent No.: US 10,400,814 B2
(45) Date of Patent: Sep. 3, 2019

(54) CABLE END LOOP ANTI-FOULING SYSTEM

(71) Applicant: CNH Industrial America LLC, New Holland, PA (US)

(72) Inventors: Parker Dan Snow, Kensal, ND (US); Daniel John Towers, Hawley, MN (US); John Thomas Rasset, Barnesville, MN (US); Nathan Carlson, West Fargo, ND (US)

(73) Assignee: CNH Industrial America LLC, New Holland, PA (US)

( * ) Notice: Subject to any disclaimer, the term of this patent is extended or adjusted under 35 U.S.C. 154(b) by 794 days.

(21) Appl. No.: 14/801,607

(22) Filed: Jul. 16, 2015

(65) Prior Publication Data

US 2016/0017911 A1 Jan. 21, 2016

Related U.S. Application Data

(60) Provisional application No. 62/025,352, filed on Jul. 16, 2014.

(51) Int. Cl.

| | |
|---|---|
| ***F16G 11/12*** | (2006.01) |
| ***F16B 45/00*** | (2006.01) |
| ***B63B 21/58*** | (2006.01) |
| ***B63B 59/04*** | (2006.01) |

(52) U.S. Cl.

CPC ..... *F16B 45/00* (2013.01); *B63B 21/58* (2013.01); *B63B 59/04* (2013.01)

(58) Field of Classification Search

CPC .... F16G 11/046; F16G 11/103; F16G 11/146; F16G 11/12; F16G 11/14; F16G 15/06; D07B 1/18; D07B 1/185

See application file for complete search history.

(56) References Cited

U.S. PATENT DOCUMENTS

| | | | | | |
|---|---|---|---|---|---|
| 1,300,794 | A | * | 4/1919 | Wendt-Wriedt | D07B 7/162 24/115 K |
| 2,189,671 | A | | 2/1940 | Mardis | |
| 2,398,403 | A | * | 4/1946 | Borgelt | H02G 3/08 174/50 |
| 2,863,198 | A | | 12/1958 | White | |
| 3,083,991 | A | * | 4/1963 | Gale | F16G 11/02 16/108 |
| 3,867,046 | A | * | 2/1975 | Fox | F16G 11/146 24/115 K |

(Continued)

FOREIGN PATENT DOCUMENTS

| | | | | |
|---|---|---|---|---|
| FR | 2 333 154 | * | 6/1977 | B66C 1/12 |
| FR | 2 343 154 | * | 9/1977 | B66C 1/12 |

(Continued)

*Primary Examiner* — Michael P Ferguson

(74) *Attorney, Agent, or Firm* — Rickard K. DeMille; Rebecca L. Henkel

(57) ABSTRACT

A system to prevent fouling in rigging is provided that includes a first plate configured to be received on a first side of a thimble for a cable end, and a second plate configured to be received on a second side of the thimble. The first plate and second plate are configured to enable the thimble to receive a ring of a shackle assembly, but to block at least one end of the shackle assembly from entering an eye of the thimble while the first and second plates are on the first and second sides of the thimble.

14 Claims, 4 Drawing Sheets

(56) References Cited

U.S. PATENT DOCUMENTS

| | | | | |
|---|---|---|---|---|
| 3,932,697 | A | 1/1976 | Hood | |
| 4,358,212 | A | 11/1982 | Compton | |
| 5,016,026 | A | 5/1991 | Flory | |
| 5,310,274 | A * | 5/1994 | Arakawa | F16G 11/02 24/115 K |
| 6,120,074 | A | 9/2000 | Hamrick | |
| 6,282,879 | B1 | 9/2001 | Bonaiti et al. | |
| 6,898,827 | B1 | 5/2005 | Postelwait et al. | |
| 8,201,309 | B1 | 6/2012 | Franta | |
| 8,256,982 | B2 | 9/2012 | Lindsey | |
| 8,607,417 | B2 * | 12/2013 | Naquin | F16G 11/14 24/115 K |
| 2016/0002008 | A1 * | 1/2016 | Foley | F16G 11/146 294/215 |

FOREIGN PATENT DOCUMENTS

| | | | | |
|---|---|---|---|---|
| FR | 2 353 761 | * | 12/1977 | F16G 11/00 |
| GB | 872658 A | | 7/1961 | |

* cited by examiner

CABLE END LOOP ANTI-FOULING SYSTEM

CROSS REFERENCE TO RELATED APPLICATIONS

This application claims priority from and the benefit of U.S. Provisional Patent Application No. 62/025,352, entitled "CABLE END LOOP ANTI-FOULING SYSTEM," filed Jul. 16, 2014, which is hereby incorporated by reference in its entirety.

BACKGROUND

The invention relates generally to rigging hardware, such as for lifting and towing, and more particularly, to an anti-fouling device placed on a thimble or a cable loop connected to a D-ring, shackle, clevis, or similar structure.

Generally, operators of boats, tractors, trucks, or other equipment often lift or tow large objects. The coupling between the vehicle and the object may be formed by a chain, a rope, a bar, a wire cable, or some other assembly for keeping the object connected to the vehicle while in motion. For example, in one exemplary towing operation, tractors may be coupled to one another to pull one machine away from or out of difficult terrain, such as in a field. The tractors often include a D-ring, shackle, clevis, or other device to facilitate coupling the chain/rope/bar/wire to the tractor. For example, a cable may include a loop at the end which extends around the d-ring/shackle/clevis. A thimble or U-shaped bolt is often installed inside the loop to reduce wear on the chain/rope/wire and to strengthen the connection.

Under certain conditions, such as turning on an uneven surface, the thimble or cable may twist to where an eye of the thimble or cable enters an end of the shackle or d-ring and bind to the end of a shackle or D-ring. For instance, on articulated agricultural tractors, turning while driving over a mound of soil can create slack in the cable. Once slack is created, the cable can twist around the D-ring. If the D-ring bolt is in contact with the thimble when the tractor straightens, the thimble and bolt can bind in a fouled position. This fouling can cause the towed object to be off center or angled, which may increase stress on the D-ring, the thimble, the cable, or a combination thereof. When this occurs, individuals who drive tractors may spend additional time to correct the binding, either with additional driving or physical removal.

BRIEF DESCRIPTION

Certain embodiments commensurate in scope with the originally claimed invention are summarized below. These embodiments are not intended to limit the scope of the claimed invention, but rather these embodiments are intended only to provide a brief summary of possible forms of the invention. Indeed, the invention may encompass a variety of forms that may be similar to or different from the embodiments set forth below.

Certain embodiments of the present disclosure block the thimble of a cable end from binding onto the end of a shackle or similar structure. In one embodiment, an anti-fouling system for a cable end includes a first plate configured to be received on a first side of a thimble of the cable end, wherein the first plate comprises at least one first fastener aperture and a first anti-fouling aperture, the first anti-fouling aperture is large enough to receive a shackle of a shackle assembly, but small enough to block at least part of a first end of the shackle assembly from entering an eye of the thimble, and a second plate configured to be received on a second side of the thimble, opposite the first side, wherein the second plate comprises at least one second fastener aperture and a second anti-fouling aperture, wherein the second anti-fouling aperture is large enough to receive the shackle, but small enough to prevent at least part of a second end of the shackle assembly from entering the eye of the thimble.

In another embodiments, a first plate configured to be received on a first side of a thimble for a cable end, and a second plate configured to be received on a second side of the thimble, opposite the first side, wherein the first plate and second plate are configured to enable the thimble to receive a ring of a shackle assembly, but to block at least one end of the shackle assembly from entering an eye of the thimble while the first and second plates are on the first and second sides of the thimble.

In yet another embodiment, an anti-fouling system includes a cable having an eye on at least one end, wherein the cable is configured to receive a ring of a shackle assembly through the eye, a thimble configured to partially surround the cable at the eye, and an anti-fouling device configured to be coupled to a mount, wherein the anti-fouling device is configured to be received through the eye of the cable, wherein the anti-fouling device is configured to secure the thimble in a centered position to substantially reduce or eliminate a possibility of the thimble from binding to at least part of a shackle assembly end.

DRAWINGS

These and other features, aspects, and advantages of the present invention will become better understood when the following detailed description is read with reference to the accompanying drawings in which like characters represent like parts throughout the drawings, wherein.

DETAILED DESCRIPTION

One or more specific embodiments of the present subject matter will be described below. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present subject matter, the articles "a," "an," "the," and "said" are intended to mean that there are one or more of the elements. The terms "comprising," "including," and "having" are intended to be inclusive and mean that there may be additional elements other than the listed elements. Any examples of operating parameters and/or environmental conditions are not exclusive of other parameters/conditions of the disclosed embodiments.

Figure 1:
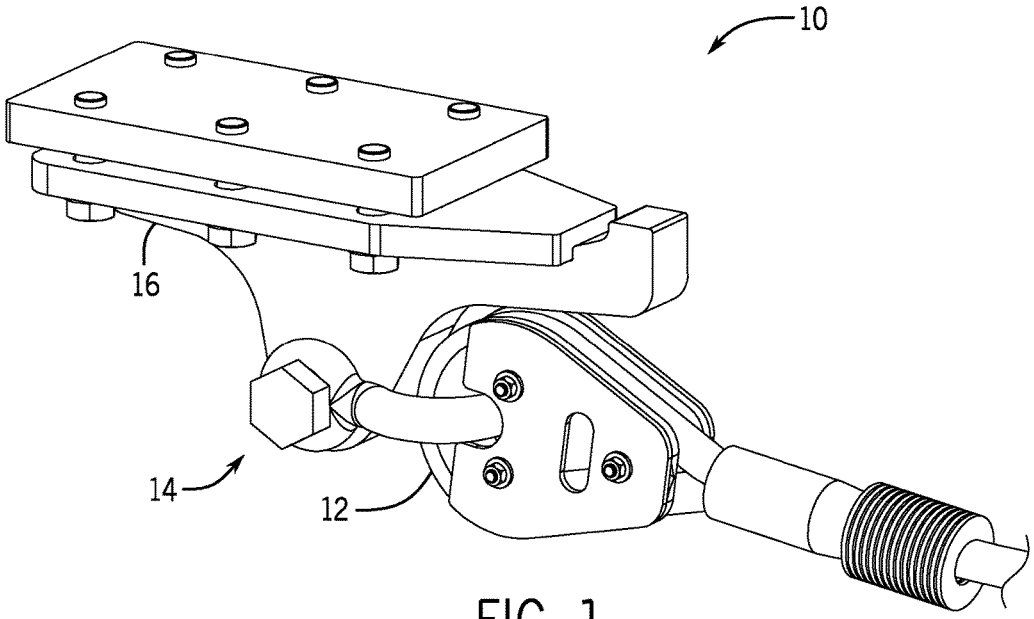
FIG. 1 is a perspective view of an embodiment of an anti-fouling system attached to a thimble connected to a shackle on a tractor.

With the foregoing in mind, FIG. 1 is a perspective view of an exemplary anti-fouling system 10 attached to a thimble 12 which is connected to a shackle 14 on a towing vehicle 16, such as a tractor. As will be appreciated, the tractor is merely an example, and the present embodiments may be used with any type of towing or rigging which may benefit from an anti-fouling system 10. The machinery may include the shackle assembly 14, a clevis, a D-ring, or some other mechanism to couple objects for towing or lifting purposes.

Figure 2:
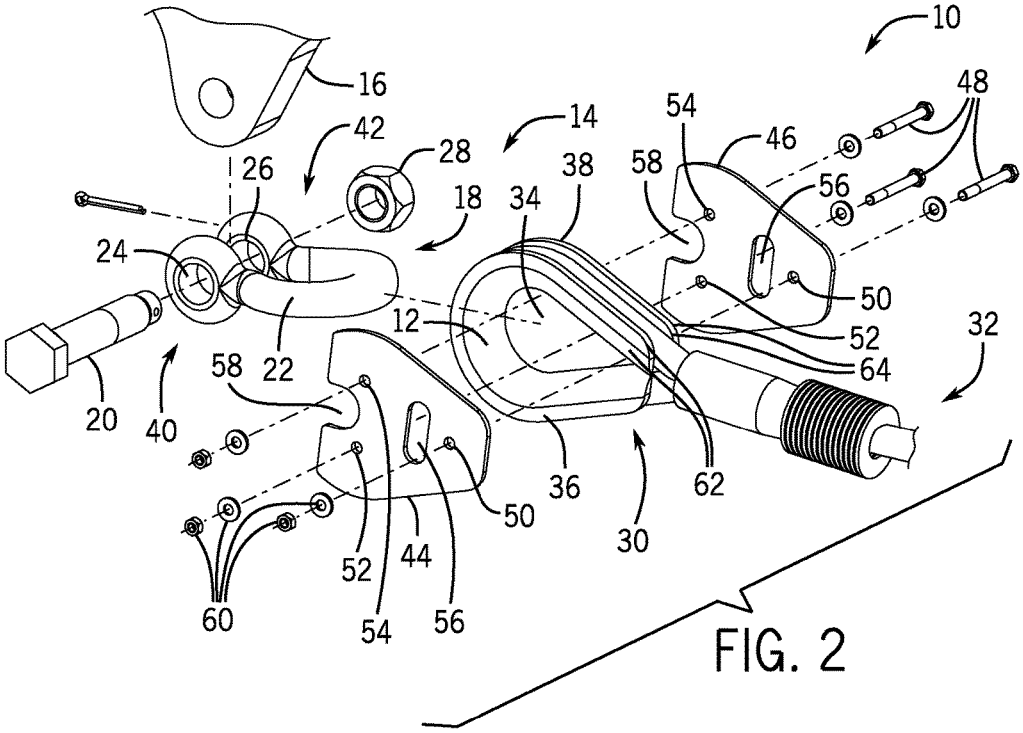
FIG. 2 is an exploded perspective view of the anti-fouling system of FIG. 1.

FIG. 2 is an exploded perspective view of an embodiment of an anti-fouling system 10 that may be employed on a towing vehicle. The towing vehicle 16 includes the shackle assembly 14 for coupling the end of a rope, chain, cable, or bar. The shackle assembly 14 includes a shackle 18 fitted with a bolt 20 or a pin. The shackle 18 includes a ring 22, and the shackle 18 may extend from a portion of the towing vehicle that articulates, or it may extend from a vehicle that does not articulate. The shackle 18 receives the bolt 20 through a first aperture 24 and a second aperture 26 to secure the shackle 18 to the towing vehicle 16. The bolt 20 may engage an appropriately sized nut 28 after the bolt passes through the two apertures and a respective aperture of the vehicle. The bolt 20 is configured to receive a cotter pin 30 or any other device to block the bolt 20 from becoming dislodged from the ring 22. As illustrated in FIG. 2, an end 30 of a rope 32 may be coupled to the clevis ring 22. To reduce wear on a rope eye 34 at the end 30 of the rope 32, the thimble 12 is installed to reinforce the loop. The thimble 12 at least partially surrounds the rope 32 at the rope eye 34, such that the rope 32 is disposed between a first side 36 and a second side 38 of the thimble 12. The rope 32 may also have a ferrule or other device for reinforcing the rope eye 34.

It should be borne in mind that, while reference is made here to towing, and specifically to towing tractors and other vehicles, the disclosure is not limited to any such application, but may be related to a wide range of uses and systems, including those for towing, lifting, binding, and so forth. Similarly, while reference is made to "rope", the devices described may be linked to cloth, fiber, and other ropes and lines, but also to wire ropes, cables, chains, rigid links, and so forth.

As discussed above, the anti-fouling system 10 is configured to block the thimble 12 from binding to an end of the shackle assembly 14, thereby substantially reducing or eliminating the possibility of fouling. In FIG. 2, for instance, a first end 40 of the shackle assembly 14 includes a portion of the bolt 20 (e.g., head) and a portion of the shackle 18 forming the aperture 24. A second end 42 of the shackle assembly 14 includes a portion of the bolt 20, the nut 28, and a portion of the shackle 18 forming the aperture 26. In FIG. 2, for instance, the bolt 20 is inserted through the shackle ends 40, 42, each positioned proximate to a respective clevis aperture 24, 26. If slack is created in the rope 32, the rope eye 34 can twist around the bolt 20, the nut 28, and/or the shackle end 40, 42. If the shackle end 40, 42 is engaged with the thimble 12 when the towing vehicle 16 straightens, the thimble 12 and the shackle end 40, 42 can bind in a fouled position. For example, the enlarged end of the ring 22 can enter into the eye 34 of the thimble 12 and cable loop. Thus, the illustrated embodiment includes an anti-fouling system having a first plate 44, a second plate 46, and fasteners 48.

The first plate 44 is configured to be received on the first side 36 of the rope eye thimble 12. The contour of the first plate 44 may be selected to match the shape of the thimble 12. This contour enables the first plate 44 to engage the thimble 12 without blocking the thimble 12 from a typical range of motion. The first plate 44 includes fastener apertures 50, 52, 54, a cleanout aperture 56, and an anti-fouling aperture 58. The fastener apertures 50, 52, 54 receive fasteners 48, such as bolts or screws. The bolts 48 extend through the fastener apertures and are secured by nuts and washers 60. One embodiment of the anti-fouling system 10 includes three fastener apertures 50, 52, 54, as illustrated. One aperture 50 may be located near the base of the thimble eye 34, while the two other fastener apertures 52, 54 may be located toward the end of the rope eye in opposite sides of the anti-fouling aperture 58. The positioning of the apertures may facilitate effective securing of the anti-fouling system 10 to the thimble 12.

Debris may build up in between the first plate 44 and the second plate 46. Thus, the first plate 44 may have a cleanout aperture 56 to facilitate debris removal. The first plate 44 may have an anti-fouling aperture 58 that is large enough to receive the ring 22 of the shackle 18, but small enough to block a shackle end 40, 42 (e.g., the bolt 20 and/or the part of the portion of the shackle 18 forming the aperture 26) from passing into the eye 34 of the thimble 12. As a result, the thimble 12 is blocked from binding to the shackle assembly 14, thereby substantially reducing or eliminating the possibility of fouling.

The second plate 46 of the anti-fouling system 10 may be similar or substantially identical to the first plate 44. The second plate 46 may have a similar or substantially identical contour matching the shape of the second side 38 of the thimble 12. The second plate 46 may also contain similar or substantially identical fastener apertures 50, 52, 54, cleanout apertures 56, and/or anti-fouling apertures 58 to the first plate 44. Employing substantially identical plates reduces the number of parts of the overall system. It should also be noted that an advantage of the systems disclosed herein is the ability to retrofit the anti-fouling hardware to existing rigging. Not all rigging requires such hardware, and kits may be created and sold or provided separately, when desired. Finally, in the first exemplary embodiment set forth above, the plates 44, 46 conform to, but do not extend beyond the periphery of the cable or rope 32 in the loop. As a result, the plates 44, 46 do not form an added impediment to movement of the cable and thimble 12. In some embodiments, the plates 44, 46 may have an outer contour that does not extend past the periphery of the thimble 12. In general, the plates 44, 46, when fixed to the thimble 12 and loop, will come to bear tightly against side flanges 62, 64 of the thimble 12 to block movement of the shackle or other connecting structure to the reduced area of the anti-fouling aperture.

Figure 3:
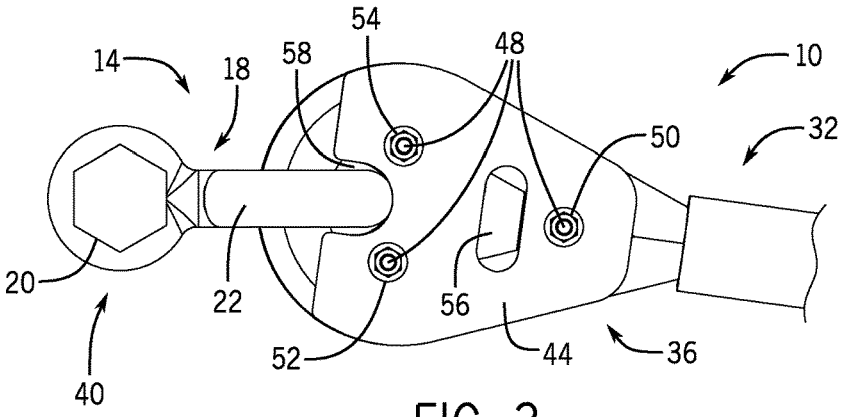
FIG. 3 is a side view of an embodiment of the anti-fouling system of FIG. 1.

FIG. 3 is a side view of the embodiment of the anti-fouling system 10 of FIGS. 1 and 2. Note that the anti-fouling aperture 58 of the first plate 44 of the anti-fouling system 10 is large enough for the shackle 18 of the shackle 18 to pass, but not large enough for the shackle 40 end to pass into the eye 34. The first plate 44, as depicted in FIG. 3, includes three fastener apertures 50, 52, 54 for three fasteners 48. The first fastener aperture 50 is located near the base of the thimble eye. The other two fastener apertures 52, 54 are located toward the end of the thimble eye 34 on opposite sides of the anti-fouling aperture 58.

FIG. 4-8 provide alternate embodiments of the anti-fouling system. In certain figures, it should be understood that the fasteners have been removed for purposes of clarity. In alternate embodiments, a single formed part may be used instead of two separate plates. The single formed part may be three sides. Similar to the first plate of the embodiment shown in FIG. 2, a first side (e.g., first plate) is configured to be received on a first side of the thimble. Similar to the second plate of the embodiment shown in FIG. 2, a second side (e.g., second plate) is configured to be received on the second side of the thimble. A third side (e.g., connector) is configured to be received across the thimble, bridging the first and second sides. The first and second sides may include fastener apertures, cleanout apertures, and anti-fouling apertures similar to the first and second plates of the embodiment shown in FIG. 2.

Figure 4:
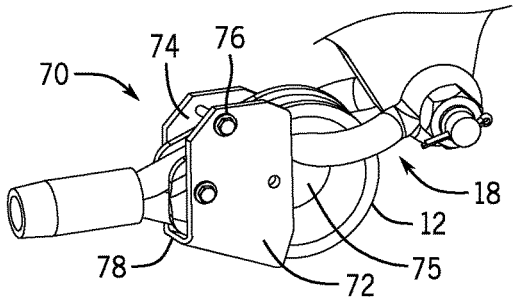
FIG. 4 is a perspective view of a first alternate embodiment of an anti-fouling system.

FIG. 4 is a perspective view of an embodiment of an anti-fouling system 70 without an anti-fouling aperture. The first side 72 and second side 74 form an opening 75 large enough for the shackle 18 (e.g., ring 22) to pass into the eye 34, but not large enough for the shackle end 40 to pass into the eye 34. Additionally, a fastener extends through a fastener aperture 76 that is located outside of the thimble (i.e., outward from the periphery of the thimble). The position of the aperture 76 enhances stability of the anti-fouling system 70. However, it should be appreciated that fastener apertures may be placed in any variety of locations to enhance stability of the anti-fouling system 70. In FIG. 4, a third side 78 (e.g., connector) that couples the first side 72 (e.g., first plate) to the second side 74 (e.g., second plate) is configured to be received across the thimble 12, thereby enclosing the rope on the side farthest from the clevis.

Figure 5:
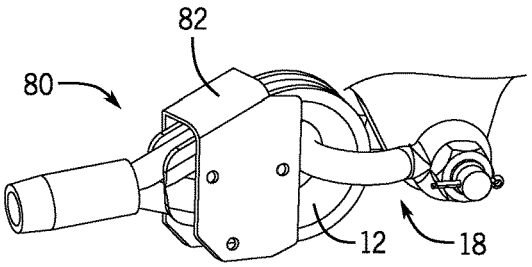
FIG. 5 is a perspective view of a second alternate embodiment of an anti-fouling system.
Figure 6:
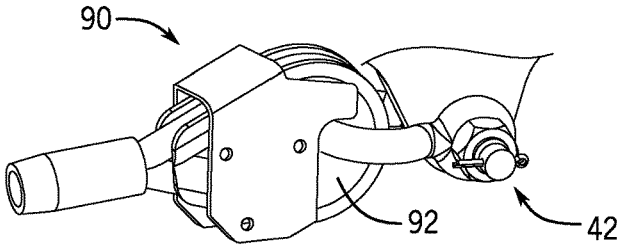
FIG. 6 is a perspective view of a third alternate embodiment of an anti-fouling system.
Figure 7:
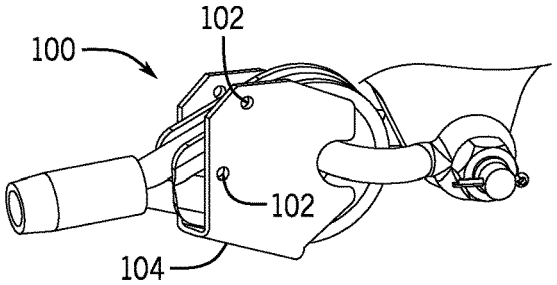
FIG. 7 is a perspective view of a fourth alternate embodiment of an anti-fouling system.
Figure 8:
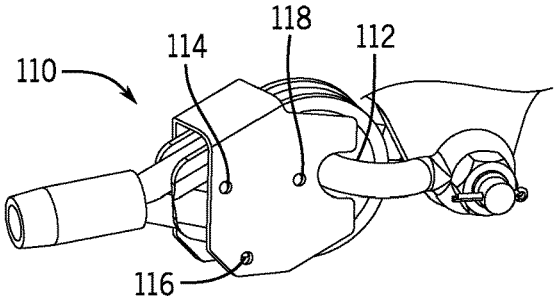
FIG. 8 is a perspective view of a fifth alternate embodiment of an anti-fouling system.

FIG. 5 is a perspective view of an anti-fouling system 80 with a third side 82 (e.g., connector) configured to be received across the thimble 12, thereby enclosing the rope on the side of the thimble near the shackle 18. FIG. 6 is a perspective view of an anti-fouling system 90 with an anti-fouling aperture 92, that is larger than the aperture 58 of FIG. 2. The aperture 90 blocks the shackle assembly end 42 (e.g., bolt end or shackle end forming the aperture for the bolt) from binding in the thimble eye 34. FIG. 7 is a perspective view of an anti-fouling system 100 with only two fastener apertures 102. The third side 104 (e.g., connector) and two fasteners may provide sufficient stability, and the plates may substantially reduce or eliminate the possibility of fouling. FIG. 8 is a perspective view of yet another alternate embodiment of the anti-fouling system 110. The alternate embodiment has an anti-fouling aperture 112 similar to the anti-fouling aperture 58 of the embodiment shown in FIG. 1. A first fastener aperture 114 is located at the base of the thimble eye, a second fastener aperture 116 is positioned outside of the thimble eye, and a third fastener aperture 118 is located near the anti-fouling aperture 112.

Figure 9:
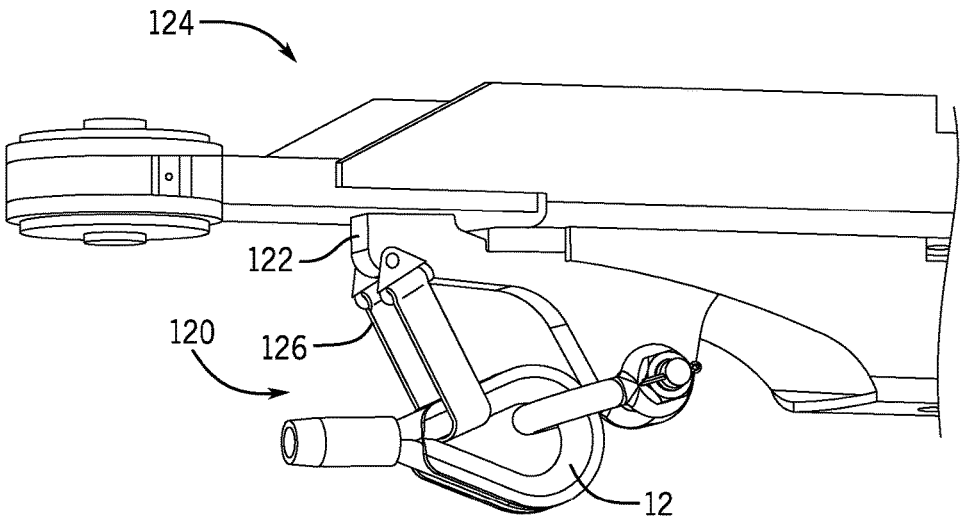
FIG. 9 is a perspective view of a sixth alternate embodiment of an anti-fouling system.
Figure 10:
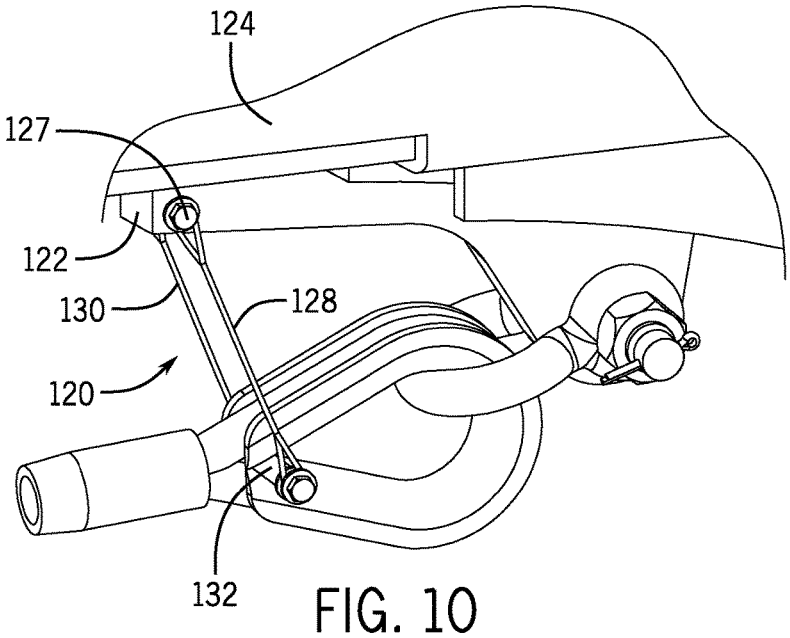
FIG. 10 is a perspective view of a seventh alternate embodiment of an anti-fouling system.

FIG. 9-10 are perspective views of anti-fouling systems 120 that substantially reduce or eliminate the possibility of fouling. As shown in FIG. 9, a mount 122 (e.g., for a vehicle 124) is configured to receive a shackle 126. The shackle 126 is coupled to the thimble 12 (e.g., extends through the eye 34) to secure the thimble 12 in a centered position. As shown in FIG. 10, a bolt 132 may couple a first cable 128 and second cable 130 to the mount 122. The first and second cables 128, 130 may run to opposite sides of an anti-fouling bolt 132 to secure the cables to the thimble 12. The first and second cables 128, 130 hold the thimble in a centered position. Such arrangements may be effective to reduce unwanted movement of the cable end and/or the connecting hardware so that fouling is substantially reduced or eliminated. The first and second cables 128, 130 or the shackle 126 may be used, where desired, with thimble eye anti-fouling arrangements of the types described above or used alone.

While only certain features of the invention have been illustrated and described herein, many modifications and changes will occur to those skilled in the art. It is, therefore, to be understood that the appended claims are intended to cover all such modifications and changes as fall within the true spirit of the invention.

The invention claimed is:

1. An anti-fouling system for a cable end, comprising:

a first substantially flat plate contacting a first lateral side of a thimble configured to receive the cable end, such that the first substantially flat plate is positioned outside of an eye of the thimble, wherein the first substantially flat plate comprises at least one first fastener aperture and a first anti-fouling aperture, and the first anti-fouling aperture is large enough to receive a ring of a shackle of a shackle assembly, but small enough to block at least part of a first end portion of the shackle assembly from entering the eye of the thimble; and a second substantially flat plate contacting a second lateral side of the thimble, opposite the first lateral side, such that the second substantially flat plate is positioned outside of the eye of the thimble, wherein the second substantially flat plate comprises at least one second fastener aperture and a second anti-fouling aperture, and the second anti-fouling aperture is large enough to receive the ring of the shackle, but small enough to block at least part of a second end portion of the shackle assembly from entering the eye of the thimble;

wherein a shape of the first and second substantially flat plates substantially corresponds to a shape of the first and second lateral sides of the thimble to cover substantially the entire periphery of the thimble opposite the ring of the shackle; and wherein the at least one first fastener aperture and the at least one second fastener aperture are positioned to be aligned with one another while the first and second substantially flat plates are on the thimble to receive at least one fastener through the eye of the thimble to secure the first and second substantially flat plates to one another.

2. The system of claim 1, wherein the first substantially flat plate is substantially identical to the second substantially flat plate.

3. The system of claim 1, wherein at least one of the first and second substantially flat plates comprises a cleanout aperture to facilitate removal of debris.

4. The system of claim 3, wherein each substantially flat plate of the first and second substantially flat plates comprises a respective cleanout aperture.

5. The system of claim 1, wherein the first substantially flat plate is configured to not extend outwardly beyond a periphery of the thimble, and the second substantially flat plate is configured to not extend outwardly beyond the periphery of the thimble.

6. The system of claim 1, wherein neither substantially flat plate of the first and second substantially flat plates is configured to extend beyond the cable.

7. An anti-fouling system, comprising:

a first substantially flat plate contacting a first lateral side of a thimble configured to receive a cable end, such that the first substantially flat plate is positioned outside of an eye of the thimble, wherein the first substantially flat plate comprises at least one first fastener aperture and a first anti-fouling aperture; and a second substantially flat plate contacting a second lateral side of the thimble, opposite the first lateral side, such that the second substantially flat plate is positioned outside of the eye of the thimble, wherein the second substantially flat plate comprises at least one second fastener aperture and a second anti-fouling aperture;

wherein the first anti-fouling aperture and the second anti-fouling aperture are configured to receive a ring of a shackle of a shackle assembly, but to block at least one end of the shackle assembly from entering the eye of the thimble while the first and second substantially flat plates are on the first and second lateral sides of the thimble, respectively;

wherein a shape of the first and second substantially flat plates substantially corresponds to a shape of the first and second lateral sides of the thimble to cover substantially the entire periphery of the thimble opposite the ring of the shackle; and wherein the at least one first fastener aperture and the at least one second fastener aperture are positioned to be aligned with one another while the first and second substantially flat plates are on the thimble to receive at least one fastener through the eye of the thimble to secure the first and second substantially flat plates to one another.

8. The system of claim 7, wherein the first substantially flat plate is substantially identical to the second substantially flat plate.

9. The system of claim 7, wherein the first and second substantially flat plates are configured to limit movement of the thimble to an area within the first and second anti-fouling apertures.

10. The system of claim 7, wherein at least one of the first and second substantially flat plates is configured to limit a bolt on the at least one end of the shackle assembly from binding to the eye of the thimble.

11. An anti-fouling system for a cable end, comprising:

a first plate having a first lateral side and a second lateral side, opposite the first lateral side of the first plate, wherein the first lateral side of the first plate contacts a first lateral side of a thimble configured to receive the cable end, the first plate comprises at least one first fastener aperture and a first anti-fouling aperture, and the first anti-fouling aperture is large enough to receive a ring of a shackle of a shackle assembly, but small enough to block at least part of a first end portion of the shackle assembly from entering an eye of the thimble; and a second plate having a first lateral side and a second lateral side, opposite the first lateral side of the second plate, wherein the first lateral side of the second plate contacts a second lateral side of the thimble, opposite the first lateral side of the thimble, the second plate comprises at least one second fastener aperture and a second anti-fouling aperture, and the second anti-fouling aperture is large enough to receive the ring of the shackle, but small enough to block at least part of a second end portion of the shackle assembly from entering the eye of the thimble;

wherein at least one plate of the first and second plates comprises a cleanout aperture, and the cleanout aperture extends from the first lateral side of the at least one plate to the second lateral side of the at least one plate to facilitate removal of debris;

wherein a shape of the first and second substantially flat plates substantially corresponds to a shape of the first and second lateral sides of the thimble to cover substantially the entire periphery of the thimble opposite the ring of the shackle; and wherein the at least one first fastener aperture and the at least one second fastener aperture are positioned to be aligned with one another while the first and second substantially flat plates are on the thimble to receive at least one fastener through the eye of the thimble to secure the first and second substantially flat plates to one another.

12. The anti-fouling system of claim 11, wherein each plate of the first and second plates comprises a respective cleanout aperture.

13. The anti-fouling system of claim 11, wherein the first plate is substantially identical to the second plate.

14. The anti-fouling system of claim 11, wherein the first plate is configured to not extend outwardly beyond a periphery of the thimble, and the second plate is configured to not extend outwardly beyond the periphery of the thimble.

* * * * *